US008654992B2

(12) United States Patent
Hayakawa

(10) Patent No.: US 8,654,992 B2
(45) Date of Patent: Feb. 18, 2014

(54) SOUND PROCESSING APPARATUS, METHOD FOR CORRECTING PHASE DIFFERENCE, AND COMPUTER READABLE STORAGE MEDIUM

(75) Inventor: Shoji Hayakawa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 1137 days.

(21) Appl. No.: 12/188,313

(22) Filed: Aug. 8, 2008

(65) Prior Publication Data

US 2009/0060224 A1 Mar. 5, 2009

(30) Foreign Application Priority Data

Aug. 27, 2007 (JP) ..... 2007-220089

(51) Int. Cl.
*H04R 1/40* (2006.01)

(52) U.S. Cl.
USPC ..... 381/97; 381/94.3; 704/226

(58) Field of Classification Search
USPC ..... 381/94.3; 704/226
See application file for complete search history.

(56) References Cited

U.S. PATENT DOCUMENTS

| | | | | |
|---|---|---|---|---|
| 5,371,481 | A | 12/1994 | Tiittanen et al. | |
| 6,339,758 | B1 * | 1/2002 | Kanazawa et al. | 704/226 |
| 7,274,794 | B1 | 9/2007 | Rasmussen | |
| 2004/0165735 | A1 | 8/2004 | Opitz | |
| 2005/0047610 | A1 | 3/2005 | Reichel | |
| 2005/0276423 | A1 | 12/2005 | Aubauer et al. | |
| 2007/0183610 | A1 * | 8/2007 | Kidmose | 381/313 |

FOREIGN PATENT DOCUMENTS

| | | |
|---|---|---|
| AU | 200042846 | 10/2000 |
| CA | 2 367 579 | 9/2000 |
| EP | 1 161 852 | 12/2001 |
| EP | 0 617 532 | 8/2002 |
| EP | 1 453 349 | 9/2004 |
| EP | 1511350 | 3/2005 |
| JP | 5-79899 | 3/1993 |
| JP | 6-326737 | 11/1994 |
| JP | 7-131886 | 5/1995 |
| JP | 8-256196 | 10/1996 |
| JP | 2002-99297 | 4/2002 |
| JP | 2002-540696 | 11/2002 |
| JP | 2004-129038 | 4/2004 |
| JP | 2004-343700 | 12/2004 |
| JP | 2005080303 | 3/2005 |
| WO | 00/57671 | 9/2000 |
| WO | 03015457 | 2/2003 |

OTHER PUBLICATIONS

Chinese Office Action dated Jul. 12, 2011, from corresponding Chinese Application No. 200810212648.X.

(Continued)

*Primary Examiner* — David Vu
*Assistant Examiner* — Jonathan Han
(74) *Attorney, Agent, or Firm* — Katten Muchin Rosenman LLP

(57) ABSTRACT

There is provided a sound processing apparatus for processing received sounds. A plurality of sound receiving units which are included in the apparatus output individually a sound signal corresponding to a received sound, then the sound signals in a time domain are converted into respective converted signal in a frequency domain, and a spectral ratio between the two converted signals is calculated for driving a phase correction value which corrects a phase of the sound signal.

10 Claims, 10 Drawing Sheets

(56) References Cited

OTHER PUBLICATIONS

European Search Report and Annex to the European Search Report, dated Nov. 10, 2008, for corresponding European Patent Application 08 16 2239.

Notice of Preliminary Rejection dated Apr. 30, 2010, for corresponding Korean Application No. 10-2008-0081220.

* cited by examiner

SOUND PROCESSING APPARATUS, METHOD FOR CORRECTING PHASE DIFFERENCE, AND COMPUTER READABLE STORAGE MEDIUM

BACKGROUND OF THE INVENTION

1. Field of the Invention

The present invention relates to a sound processing apparatus for converting sounds receiving by a plurality of sound receiving units to sound signals which are processed. More specifically, the present invention relates to a sound processing apparatus for correcting the phase differences between the sound signals, method, and a computer readable storage medium a storing a computer program therefor.

2. Description of the Related Art

Various sound processing apparatuses for, for example, identification of directions from which sound comes using a plurality of microphones have been developed and are in practical use. One of these apparatus will now be described. FIG. 11 is a perspective view illustrating an example of an outside shape of the sound processing apparatus. In FIG. 11, a shape of a housing of a cellular phone in which the sound processing apparatus 1000 is built is as a rectangular parallelepiped, the sound processing apparatus 1000 using the cellular phone has a casing 1001. The first microphone 1002 for receiving voice uttered by a speaker is disposed at the front of the casing 1001. Moreover, the second microphone 1003 is disposed at the bottom of the casing 1001.

Receiving sounds from various directions and processing the phase difference corresponding to the time difference between the sounds received by the first microphone 1002 and the second microphone 1003, the sound processing apparatus 1000 identifies the direction from which the sound comes on the basis of the phase difference. Then, the sound processing apparatus 1000 achieves a desired characteristics of directivity by performing processes such as suppressing the sound received by the first microphone 1002 in accordance with the direction from which the sound comes.

The sound processing apparatus 1000 as shown in FIG. 11 requires microphones having the same characteristics, for example, the same sensitivity. FIG. 12 is a radar chart illustrating measurement results of the directivity of the sound processing apparatus 1000. The radar chart shown in FIG. 12 illustrates signal power (dB) of the sound after the sound received by the first microphone 1002 of the sound processing apparatus 1000 is suppressed for each direction from which the sound comes. Herein, the azimuth indicating the direction is taken as shown in FIG. 12, that is, when the sound comes from the front of the casing 1001 where the first microphone 1002 is disposed in the sound processing apparatus 1000 is defined as 0°. The azimuth when the sound comes from the right is defined as 90°. The azimuth when the sound comes from the back is defined as 180°, and the azimuth when the sound comes from the left is defined as 270°. The each direction is shown in "degree" around the radar chart in FIG. 12, where a solid line indicates signal power in each direction in state 1 where the sensitivities of the first microphone 1002 and the second microphone 1003 are the same, a dashed line indicates signal power in a state 2 where the sensitivity of the first microphone 1002 is higher than that of the second microphone 1003, and an alternate long and short dash line indicates signal power in a state where the sensitivity of the second microphone 1003 is higher than that of the first microphone 1002. When the directivity of the state 1 where the sensitivities of the first microphone 1002 and the second microphone 1003 are the same is desired, the directivities at the directions of 90°, 270° and 180° in the states 2 and 3 vary too widely each other. Namely, the directivity varies widely according to the sensitivities of microphones.

Individual differences between the microphones affect the characteristics of the sound processing apparatus as shown in FIG. 12. However, typically produced microphones have individual differences such as sensitivity differences within predetermined specifications. In order to adjust the microphones so as their characteristics being identical, methods for solving this problem are proposed, for example, in Japanese Laid-open Patent Publications No. 2002-99297 and 2004-343700, in which teacher signals generated at a position equidistantly located from a plurality of microphones are used.

SUMMARY

However, the proposed methods should be applied to every pair of microphones set in a sound processing apparatus. That is, every pair of microphones set to every sound processing apparatus. Therefore the cost for producing the sound processing apparatus increases. Besides, after shipment, the proposed methods would be difficult to be applied against characteristic alteration, such as deterioration with age, the characteristic of the microphones will differ from each other.

Therefore, an object of the present invention is to provide an apparatuses capable of correcting the variation of sensitivity of a plurality of microphone included in the apparatus with low production cost and of correcting the change of characteristics caused by deterioration with age.

According to an embodiment of the present invention, there is provided apparatuses capable of receiving temporal signals from a plurality of microphones, transforms each of the sound signal in a time domain into each corresponding signal in a frequency domain, and derives a spectral ratio of two signals in the frequency domain and a phase correction value for correcting a phase difference between the two signals on the basis of the spectral ratio. In the embodiment, the number of signals is two or more, and the microphones can be included in the apparatus.

DESCRIPTION OF THE PREFERRED EMBODIMENTS

Embodiments of the present invention will now be described with reference to the drawings.

First Embodiment

Figure 1:
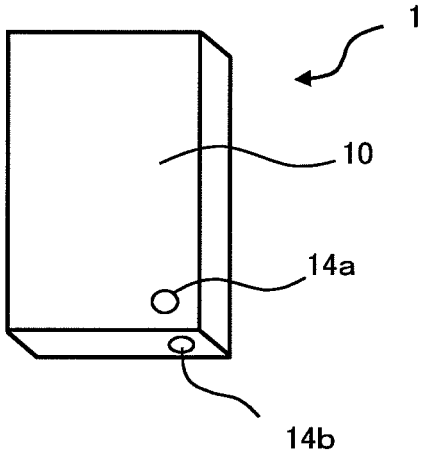
FIG. 1 shows a perspective view illustrating an example of the outside shape of a sound processing apparatus according to a first embodiment.

FIG. 1 shows a perspective view illustrating an example of an outside shape of a sound processing apparatus 1 according to the first embodiment of the present invention. In FIG. 1, reference number 1 denotes the sound processing apparatus 1 having a rectangular-parallelepiped casing 10 and of the present invention uses a computer such as used in a cellular phone which is also set in the casing 10. The sound processing apparatus 1 is included a rectangular-parallelepiped casing 10. The first sound receiving unit 14*a* using a microphone such as a condenser microphone for receiving sound produced by a speaker is disposed at the front of the casing 10. Moreover, the second sound receiving unit 14*b* such as a condenser microphone is disposed at the bottom of the casing 10. The second sound receiving unit 14*b* is preferably a same kind of microphone used as the first sound receiving unit 14*a*. Sounds come from various directions to the sound processing apparatus 1, and the sound processing apparatus 1 determines the direction from which the sound comes on the basis of the phase difference corresponding to the time difference between the sounds that arrive at the first and second receiving units 14*a* and 14*b*. The sound processing apparatus 1 achieves a desired directivity by performing processes such as suppressing the sound received by the first sound receiving unit 14*a* in accordance with the direction from which the sounds come. In the description below, the first and second sound receiving units 14*a* and 14*b* are referred to as sound receiving units 14 when these units do not need to be distinguished.

Figure 2:
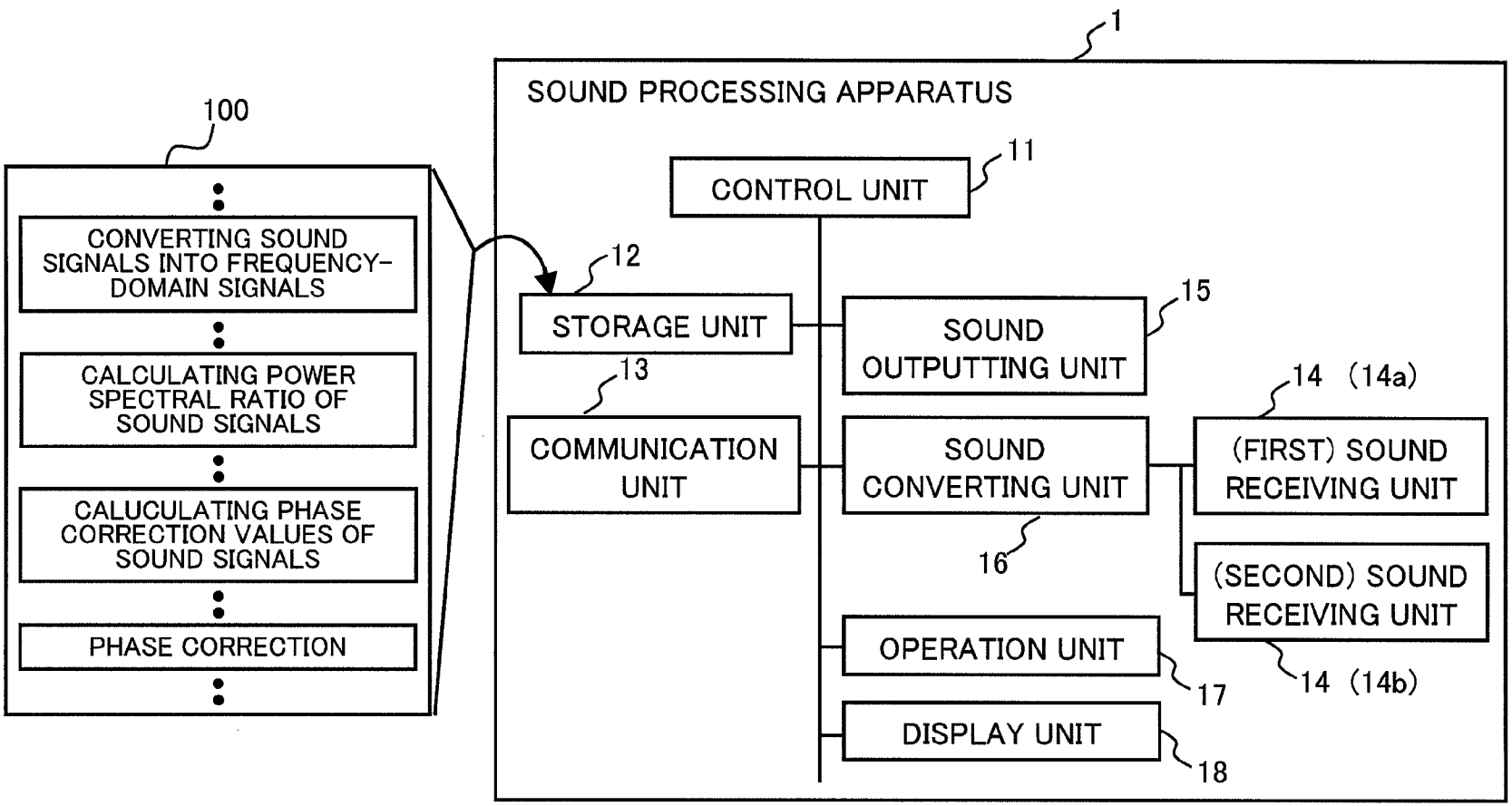
FIG. 2 is a block diagram illustrating an exemplary hardware configuration of the sound processing apparatus according to the first embodiment.

FIG. 2 is a block diagram illustrating an exemplary hardware configuration of the sound processing apparatus 1 according to the first embodiment of the present invention. In FIG. 2, the sound processing apparatus 1 includes a computer which may be one used in such as a cellular phone. The sound processing apparatus 1 includes, a control unit 11 such as CPU (Central Processing Unit) that controls the entire apparatus; a storage unit 12 such as a ROM and a RAM that stores programs such as a computer program 100 and data such as various setting values, and a communication unit 13, which preferably includes an antenna as a communication interface and devices attached thereto. The sound processing apparatus 1 further includes; the sound receiving units 14 such as microphones that receive external sound and converts the external sound to analog sound signals, a sound outputting unit 15 that outputs sounds, such as a loudspeaker, and a sound converting unit 16 that converts the sound signals. In addition, the sound processing apparatus 1 includes; an operation unit 17 that accepts operations by key entry of, for example, alphanumeric characters and various commands, and a display unit 18 such as a liquid-crystal display that displays various types of information. Herein, the sound processing apparatus 1 includes two sound receiving units 14*a* and 14*b*. However, the present invention is not limited to this, and can be provided with three or more sound receiving units 14. The computer such as a cellular phone operates as the sound processing apparatus 1 of the present embodiment by executing various processes included in the computer program 100 in the control unit 11.

Figure 3:
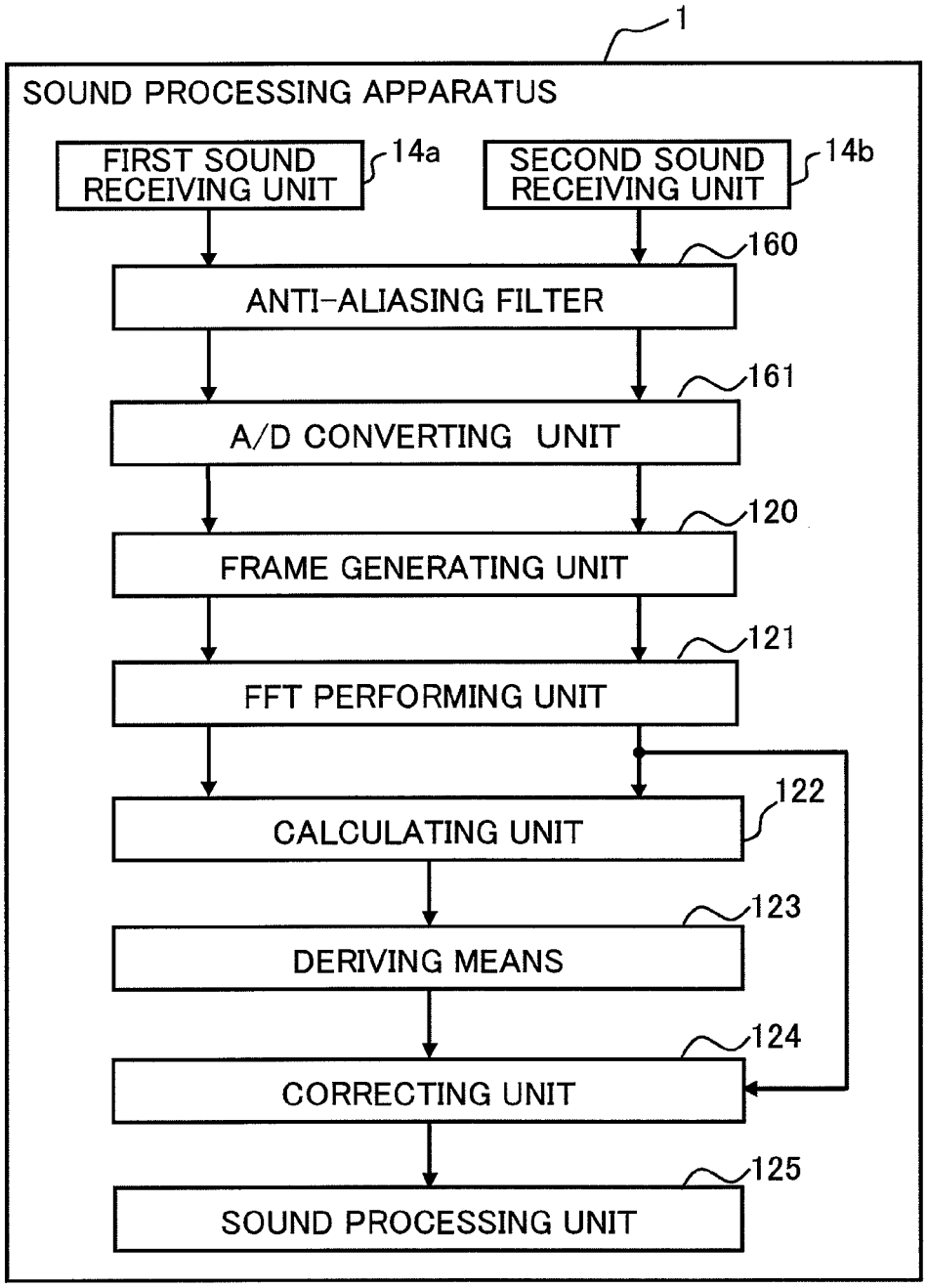
FIG. 3 is a functional block diagram illustrating an exemplary function of the sound processing apparatus according to the first embodiment.

FIG. 3 is a functional block diagram illustrating an exemplary function of the sound processing apparatus 1 according to the first embodiment. The sound processing apparatus 1 includes, the first sound receiving unit 14*a* and the second sound receiving unit 14*b* that receive analog sounds, A/D converter 161 that converts the analog sound signals into the digital signals, and an anti-aliasing filter 160 functioning as an LPF (Low Pass Filter) that prevents aliasing errors during converting of the analog sounds into digital signals. The first sound receiving unit 14*a* and the second sound receiving unit 14*b* include amplifiers (not shown) that amplify the analog sound signals. The anti-aliasing filter 160 and the A/D converter 161 are functions that are performed in the sound converting unit 16. Instead of being included in the sound converting unit 16 in the sound processing apparatus 1, the anti-aliasing filter 160 and the A/D converter 161 can be implemented on external sound capturing devices together with the sound receiving units 14.

The sound processing apparatus 1 further includes, a frame generating unit 120 that generates frames having a predetermined time length serving as a processing unit from the sound signals, FFT (Fast Fourier Transformation) performing unit 121 that converts the sound signals into frequency-domain signals by FFT processing, a calculating unit 122 that calculates power spectral ratios of the sound signals converted into the frequency domain, deriving unit 123 that derives phase correction values of the sound signals of the sound received by the second sound receiving unit 14*b* on the basis of the spectral ratios, correcting unit 124 that corrects the phases of the sound signals of the sound received by the second sound receiving unit 14*b* on the basis of the correction values, and sound processing unit 125 that performs processes such as suppressing the sound received by the first sound receiving unit 14*a*. Herein, the frame generating unit 120, the FFT performing unit 121, the calculating unit 122, the deriving unit 123, the correcting unit 124, and the sound processing unit 125 are functions as software realized by executing various computer programs in the storage unit 12. However, these functions can be realized by using dedicated hardware such as various processing chips of integrated circuits.

Next, operations of the sound processing apparatus 1 according to the first embodiment will be described. Before the sound processing unit 125 executes the above-described processes on the basis of the sound received by the first and second sound receiving units 14*a* and 14*b*, the sound processing apparatus 1 performs phase correction so that an individual difference such as a sensitivity difference between the first and second sound receiving units 14*a* and 4*b* is decreased. First, influences of the sensitivity difference between the first and second sound receiving units 14*a* and 14*b* exerted on the phases will be described.

Figure 4:
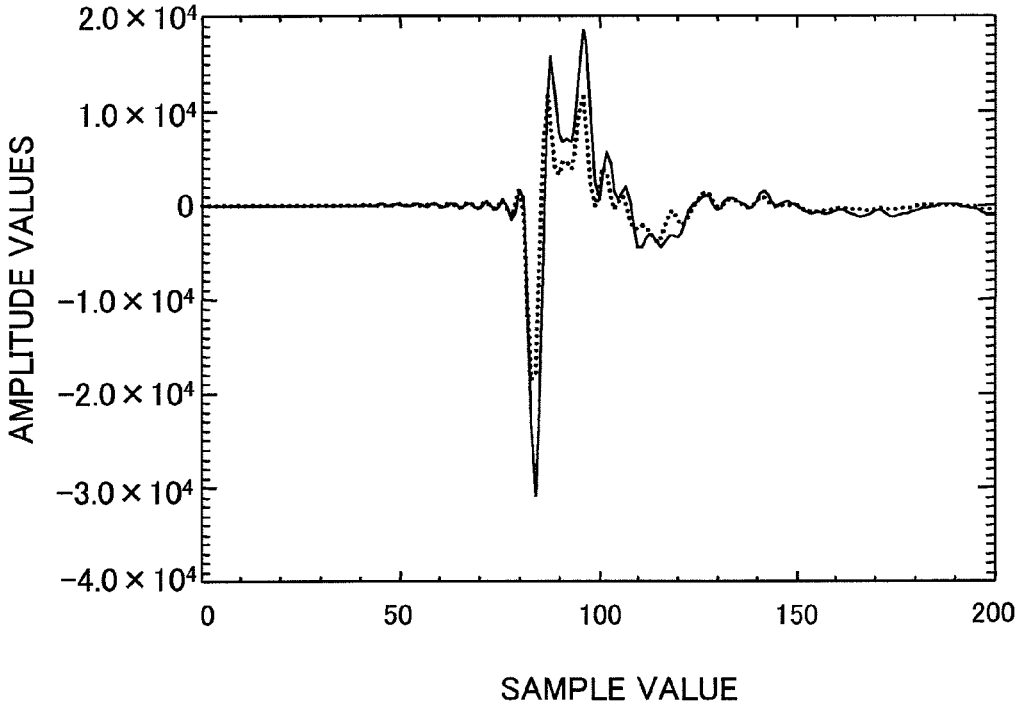
FIG. 4 illustrates a difference between sound waveforms caused by the sensitivity difference between microphones.

Each of same type microphones having different sensitivity outputs a different signal in a waveform, while receiving sounds from a same sound source. To show the fact, each of impulse responses outputted from the microphones is shown in FIG. 4, where a pair of the microphones of a same type one used in the present embodiment has different sensitivities each other and the sound incident on each microphone is an impulse. The horizontal axis of the graph in FIG. 4 represents sample values and the vertical axis represents amplitude values of the outputted signals, where the sample values indicates the order of samples of the output signals form the microphones sampled at a period of 96 kHz. The sample value 100 corresponds to about 1.04 ms when the output signal is sampled at a period of 96 kHz. The solid line shows the waveform outputted from the microphone having a higher sensitivity and the dashed line shows one of a lower sensitivity. When compared to the waveform outputted from the lower sensitivity microphone, the waveform outputted from the higher sensitivity microphone varies largely in amplitude and slowly in time. However, the waveform of signal outputted from the lower sensitivity namely advances in phase as compared to that of the higher sensitivity microphone.

Figure 5:
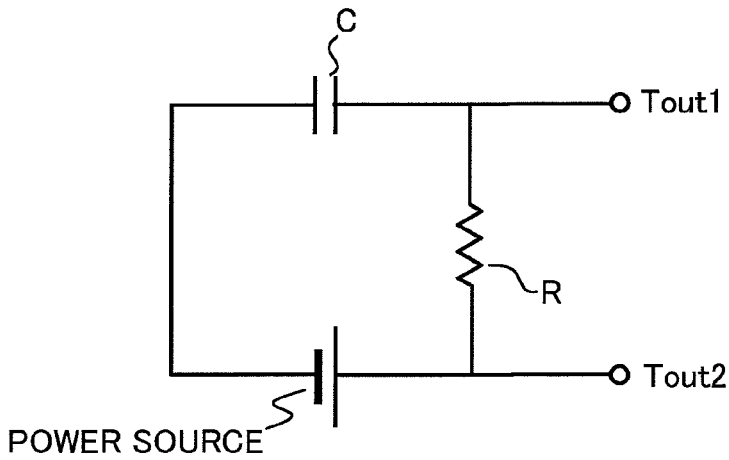
FIG. 5 is a circuit diagram illustrating an equivalent circuit of a microphone.

To confirm the results shown in FIG. 4, the following theoretical consideration was executed. The relationship between the sensitivity difference and the advancement of the phase will be now described with reference to an equivalent mechanical circuit of an electrical system of a microphone. First, the equivalent circuit of the condenser microphone, which is used the sound receiving units 14, can be shown as the diagram indicated in FIG. 5, where a capacitor of capacitance value C and a resistor of resistance value R are connected in parallel with respect to output terminals Tout1 and Tout2. After the condenser microphone is once vibrated by outer sound pressure, the variation of the output voltage appeared between the output terminals Tout1 and Tout2 is equivalent to a damped oscillation with a spring constant k (=1/C) on which the resistance R acts. Herein, it is supposed that the equivalent circuit shown in FIG. 5 can be represented as the following equation 1 showing the equation of motion.

$$\ddot{x}+2R\dot{x}+\omega^2=0,(\omega=\sqrt{k/m}) \qquad \text{Equation (1)}$$

where, x is an output voltage, R is a resistance, ω is an angular frequency, k is a spring constant of a virtual spring, and m is a weight to the virtual spring.

Solving Equation (1) for x gives the following solution (2).

$$x = e^{-Rt}\left(A\ e^{jt\sqrt{\omega^2-R^2}} + Be^{-jt\sqrt{\omega^2-R^2}}\right) \qquad \text{Equation (2)}$$

where, A and B are constants.

Equation (2) can be transformed into the following Equation (3).

$$x=e^{-Rt}\sin(\sqrt{\omega^2-R^2}t) \qquad \text{Equation (3)}$$

Figure 6:
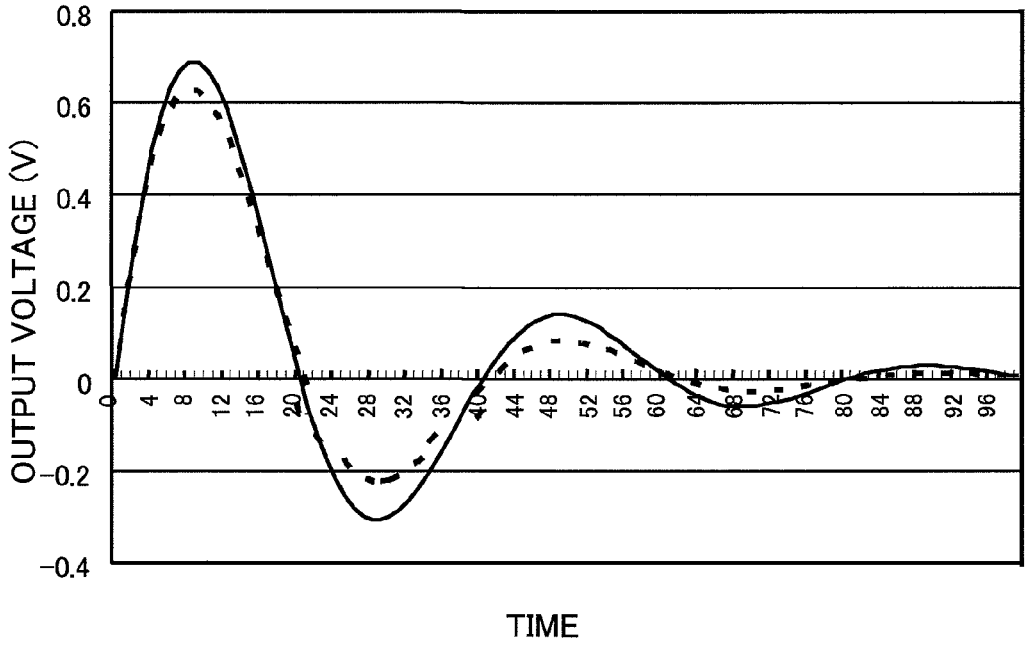
FIG. 6 illustrates changes in output voltage on the basis of an equation of motion.

FIG. 6 illustrates temporal changes in x as the output voltage represented by equation (3) of solution of equation of motion (1). The solid line shows a theoretical temporal change of x in the case of a small value of the resistance R where R=0.04 and $\omega^2$=0.026, and the dotted line in the case of a large value of the R where R=0.05 and $\omega^2$=0.026. The equation (3) and FIG. 6 show that the change of the output voltage shown by the dotted line has a smaller maximum amplitude, which is represented by the term $e^{-Rt}$, than that represented by the solid line. Further the entire waveform of the dotted line advances in respect to that of the solid line, that is, the waveform represented by the dotted line advances in phase in respect to the waveform represented by the solid line. Supposing that the higher the amplitude of output voltage from the microphone is, the higher the sensitivity of the microphone is, the sound signal of a microphone of a lower sensitivity results in the advancement in phase in respect to the sound signal outputted from the microphone having a higher sensitivity. This result agrees with the experimental results of the impulse responses shown in FIG. 4. Supposing that the output voltage x in the case of a high resistance R has a larger amplitude and an advanced phase. When a plurality of microphones having different sensitivities are used on the assumption that the amplitudes of the output voltage x correspond to the sensitivities of the microphones, the phase of a sound signal captured by a microphone with a low sensitivity is advanced compared with that of a sound signal captured by a microphone with a high sensitivity. This agrees with the experimental results of the impulse responses shown in FIG. 4.

The sensitivity difference between the microphones can be identified by the amplitudes of the sound signals as described above. Since the sensitivity difference affects the phases, the sound processing apparatus 1 of the present invention corrects the phases on the basis of the values of power spectra corresponding to the amplitudes so that influences of the sensitivity difference between the sound receiving units 14 are reduced.

Figure 7:
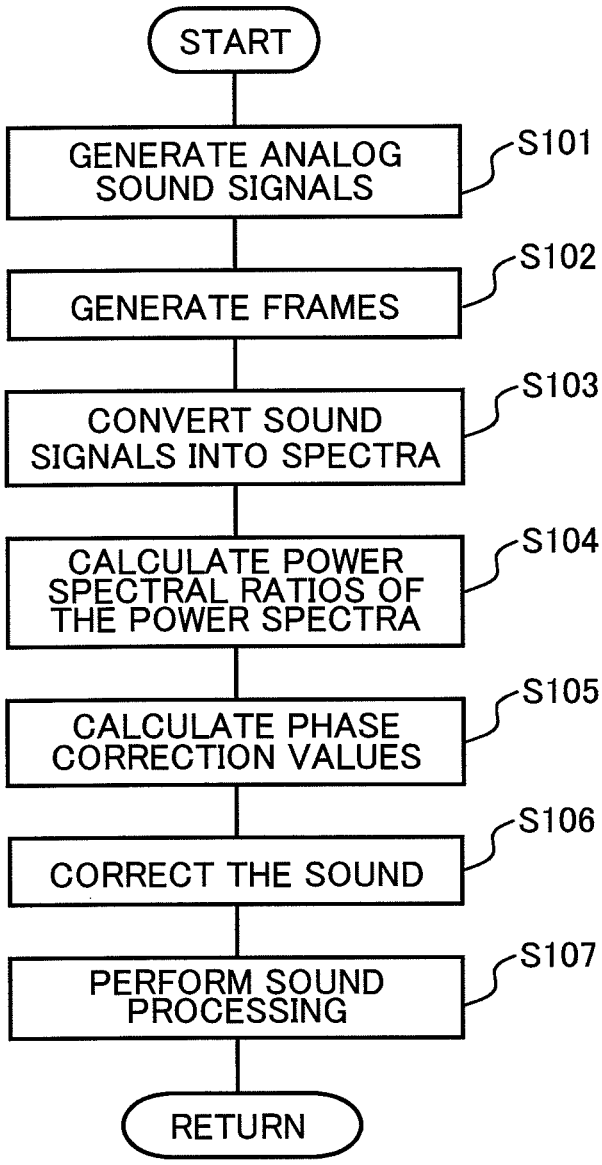
FIG. 7 is an operation chart illustrating exemplary processes performed by the sound processing apparatus according to the first embodiment.

Referring to the operation chart shown in FIG. 7, exemplary one of processes performed by the sound processing apparatus 1 according to the first embodiment will be described. In operation S101, Each analog sound signal outputted from the corresponding sound receiving units 14 is filtered with the anti-aliasing filter 160 and then transformed into the digital signal respectively with the A/D converter 161, these processes of which are controlled by the control unit 11.

The sound processing apparatus 1 divides frames, each having a predetermined time length, from each of the digitalized sound signals by the frame generating unit 120 on the basis of the control of the control unit 11, where each of the frames serves as a unit to be processed. The predetermined time length is, for example, in a range of about 20 to 40 (S102). Furthermore, each frame is shifted by, for example, in a range of about 10 to 20 ms during framing.

The sound processing apparatus 1 converts the sound signals in units of frames into spectra serving as frequency-domain signals by FFT (Fast Fourier Transformation) processing in the process performed by the FFT performing unit 121 on the basis of the control of the control unit 11 (S103). In operation S103, the sound signals are converted into phase spectra and amplitude spectra. In the following process, power spectra, which are the squares of the amplitude spectra, will be used. However, the amplitude spectra can be used instead of the power spectra in the following process.

The sound processing apparatus 1 calculates power spectral ratios of the power spectra. One power spectral is based on the sound received by the second sound receiving unit 14*b*. The other power spectral is based on the sound received by the first sound receiving unit 14*a*. The power spectra are obtained in the process performed by the calculating unit 122 on the basis of the control of the control unit 11 (S104). In operation S104, the ratios are calculated for each power spectra set for each frequency using the following Equation (4).

$$\text{ratio}=S2(\omega)/S1(\omega) \qquad \text{Equation (4)}$$

where, ω is an angular frequency, S1(ω) is a power spectrum based on a sound signal from the first sound receiving unit 14*a*, and S2(ω) is a power spectrum based on a sound signal of the second sound receiving unit 14*b*.

The sound processing apparatus 1 calculates phase correction values of the sound signals in frequency-domain of the second sound receiving unit 14*b* with respect to the sound signals in frequency-domain of the first sound receiving unit 14*a* on the basis of the power spectral ratios shown in Equation (4) in the process performed by the deriving unit 123 on the basis of the control of the control unit 11 (S105). In operation S105, the correction values are calculated using the following equation (5).

$$P\text{comp}(\omega)=[\alpha F\{S_1(\omega)/S_2(\omega)\}]\omega+\beta \quad \text{Equation (5)}$$

where, Pcomp(ω) is a phase correction value, α and β are constants, and $F\{S_1(\omega)/S_2(\omega)\}$ is a function of $S_1(\omega)/S_2(\omega)$ as a variable.

How the constants α and β in equation (5) are determined will now be described. First, a unit for adjustment including two sets of microphones, that is, a set of a microphone with the highest sensitivity and that with the lowest sensitivity is set. Further a set of microphones with the same or substantially same sensitivity, among those of the same kind (type) used as the sound receiving units 14, is prepared as well. Subsequently, white noise is reproduced at a position located equidistant from the microphones in each set, and a phase-difference spectrum, the difference between the each phase spectrum of the signal outputted from each of microphones, $((\phi_2(\omega)-\phi_1(\omega))$ for each microphone set is determined. Finally, the constants α and β are determined in such a way that the phase-difference spectrum of the microphone set having different sensitivities fits that of the microphone set having the same or substantially same sensitivity. The each datum of determined constants α and β are stored in the storage unit 12 of the sound processing apparatus 1. The process in operation S105 can be performed by using the same type of microphones as those used for the adjustment as the sound receiving units 14. The function F in equation (5) is selected from, for example, a logarithmic function such as a common logarithm and a natural logarithm, and a sigmoid function as appropriate.

The sound processing apparatus 1, in the process performed by the correcting unit 124 on the basis of the control of the control unit 11, adds the phase correction values calculated in operation S105 to the phases of the sound signals in the frequency domain of the second sound receiving unit 14*b* so as to correct the sound signal of the second sound receiving unit 14*b* (S106). In operation S106, the sound signals are corrected using the following equation (6).

$$\phi'_2(\omega)=\phi_2(\omega)+P_{comp}(\omega) \quad \text{Equation (6)}$$

where $\phi_2(\omega)$ is a phase spectrum based on the sound received by the second sound receiving unit 14*b* and $\phi_2(\omega)$ is a corrected phase spectrum.

The sound processing apparatus 1, on the basis of the control of the control unit 11, performs various sound processing such as suppressing the sound received by the first sound receiving unit 14*a* on the basis of the sound signals of the first sound receiving unit 14*a* and the sound signals, whose phases are corrected, of the second sound receiving unit 14*b* in the process performed by the sound processing unit 125 (S107).

Equation (5) used in operation S105 can be changed in accordance with the shape and/or the details of the sound processing of the sound processing apparatus 1 as appropriate. For example, the following Equation (7) can be used instead of Equation (5).

$$P_{comp}(\omega)=\alpha F\{S_2(\omega)/S_1(\omega)\}+\beta \quad \text{Equation (7)}$$

Equation (5) is suitable for correcting phase spectra under a normal operation when the first and second sound receiving units 14*a* and 14*b* are vertically arranged in the sound processing apparatus 1 as shown in FIG. 1. On the other hand, Equation (7) is suitable for correcting phase spectra when the first sound receiving units 14*b* and 14*b* are horizontally arranged in the front face of the sound processing apparatus 1. It is, namely, desired that equations to be used are investigated in accordance with the positions as appropriate.

The above explanation for the correction is for the phases of sound signals according to the second sound receiving unit 14*b*. Furthermore it is also possible to correct the phases of the sound signals of the first sound receiving unit 14*a* by converting $S_2(\square)/S_1(\square)$ to $S_1(\square)/S_2(\square)$ in the function F of Equations (5) and (7). Alternatively, for the same object, the following Equation (8) can be used instead of Equation (6) for correcting the phases of the sound signals of the first sound receiving unit 14*a*.

$$\phi'_1(\omega)=\phi_1(\omega)-P_{comp}(\omega) \quad \text{Equation (8)}$$

where $\phi_1(\omega)$ is a phase spectrum based on the sound received by the first sound receiving unit 14*a* and $\phi'_1(\omega)$ is a phase spectrum after correction.

Figure 8A:
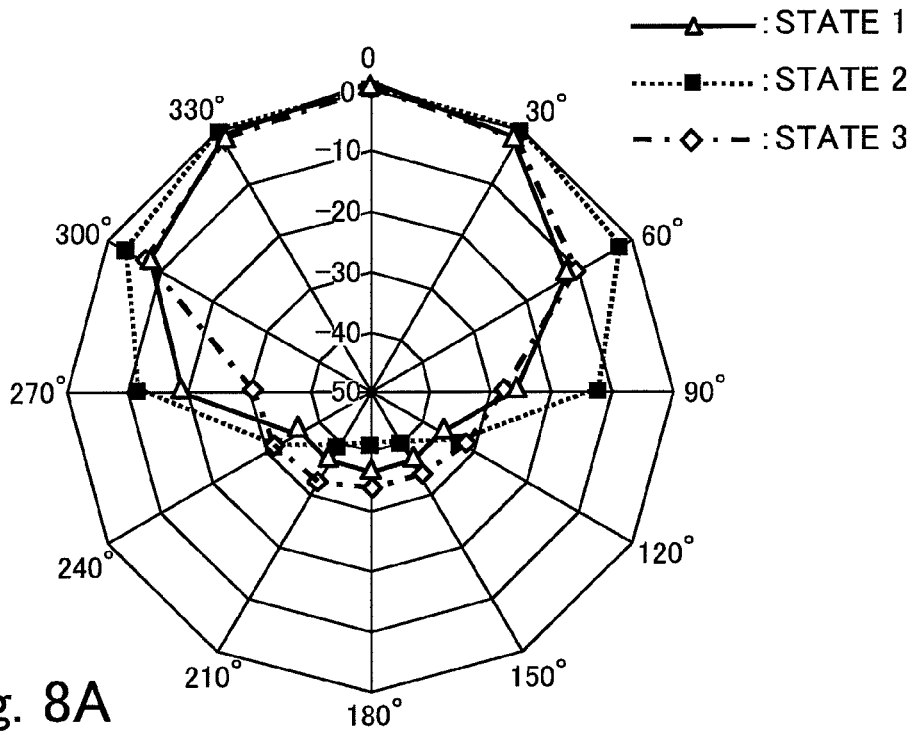
FIGS. 8A and 8B are radar charts illustrating exemplary results of correcting the sensitivity difference using the sound processing apparatus according to the first embodiment.
Figure 8B:
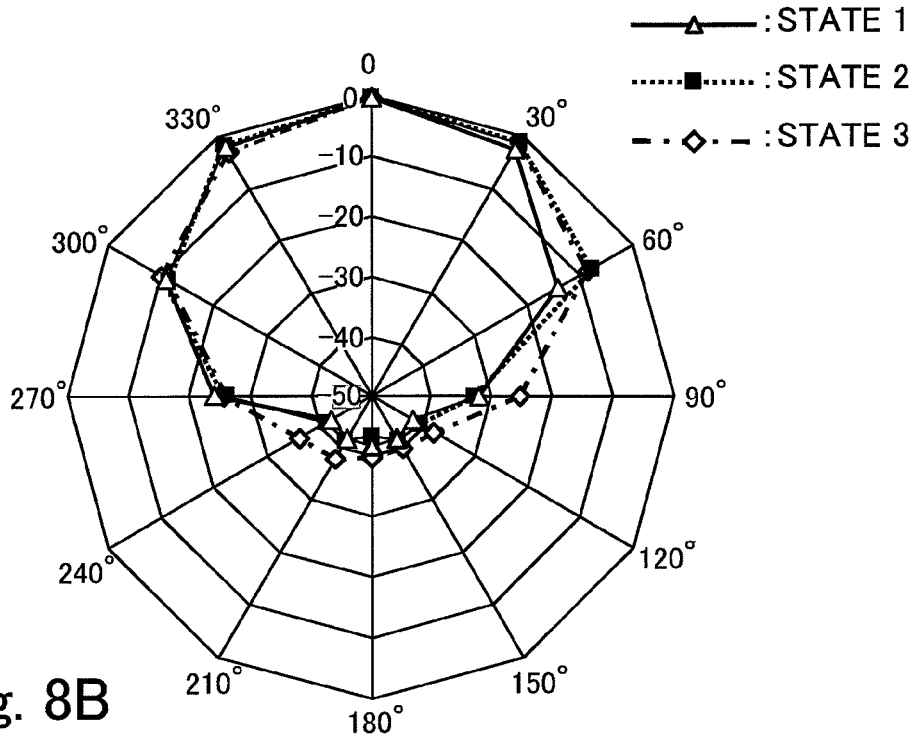

Next, the results of correcting the sensitivity difference using the sound processing apparatus 1 will be described. FIGS. 8A and 8B are radar charts illustrating exemplary results of correcting the sensitivity difference using the sound processing apparatus 1. FIGS. 8A and 8B illustrate directivities achieved by identifying the direction from which the sound comes on the basis of the phase difference between respective sounds received by the first and the second sound receiving units 14*a* and 14*b* and by performing processes such as suppressing the sound received by the first sound receiving unit 14*a* in accordance with the direction from which the sound comes in the sound processing performed by the sound processing unit 125. The directivities shown in the radar charts in FIGS. 8A and 8B are indicated by signal power (dB) after the sound processing is performed on the sound received by the first sound receiving unit 14*a* for each direction from which the sound comes. Herein, the azimuth when the sound comes from the front of the casing 10 where the first sound receiving unit 14*a* is disposed in the sound processing apparatus 1 is defined as 0°, the azimuth when the sound comes from the right is defined as 90°, the azimuth when the sound comes from the back is defined as 180°, and the azimuth when the sound comes from the left is defined as 270°. FIG. 8A illustrates directivities when the sensitivity difference between the first sound receiving unit 14*a* and the second sound receiving unit 14*b* is not corrected. A solid line indicates a state 1 where the sensitivities of the first sound receiving unit 14*a* and the second sound receiving unit 14*b* are the same, a dashed line indicates a state 2 where the sensitivity of the first sound receiving unit 14*a* is higher than that of the second sound receiving unit 14*b*, and an alternate long and short dash line indicates a state 3 where the sensitivity of the second sound receiving unit 14*b* is higher than that of the first sound receiving unit 14*a*. FIG. 8B illustrates directivities when the sensitivity difference is corrected by the sound processing apparatus 1 of the present invention. A solid line indicates a state 1 where the sensitivities of the first sound receiving unit 14*a* and the second sound receiving unit 14*b* are the same, a dashed line indicates a state 2 where the sensitivity of the first sound receiving unit 14*a* is higher than that of the second sound receiving unit 14*b*, and an alternate long and short dash line indicates a state where the sensitivity of the second sound receiving unit 14*b* is higher than that of the first sound receiving unit 14*a*.

As shown in FIG. 8A, the directivities at the sides and the back vary in the states 2 and 3 where the sensitivities of the first sound receiving unit 14*a* and the second sound receiving unit 14*b* differ from each other compared with the state 1 where the sensitivities of the first sound receiving unit 14*a* and the second sound receiving unit 14*b* are the same. In contrast, as shown in FIG. 8B, the directivities in the states 2 and 3 are similar to that in the state 1 in all directions since the influence of the sensitivity difference in the states 2 and 3 is eliminated or decreased.

In the first embodiment, the sound processing apparatus includes two sound receiving units. However, the present invention is not limited to this, and the sound processing apparatus can be provided with three or more sound receiving units. When the sound processing apparatus includes three or more sound receiving units, the sensitivity differences can be reduced by defining the sound signal of one of the sound receiving units as a reference signal and by performing calculation of power spectral ratios, calculation of phase correction values, and correction of phases on the sound signals of the other sound receiving units.

Second Embodiment

In a second embodiment, the sound processing apparatus according to the first embodiment is modified in view of, for example, reducing the processing load and preventing sudden changes in sound quality. Since the outside shape and exemplary configurations of hardware of the sound processing apparatus according to the second embodiment are similar to those according to the first embodiment, those according to first embodiment will be referred and the descriptions thereof will be omitted. In the description below, the same reference numbers are used for components substantially the same as those in the first embodiment.

Figure 9:
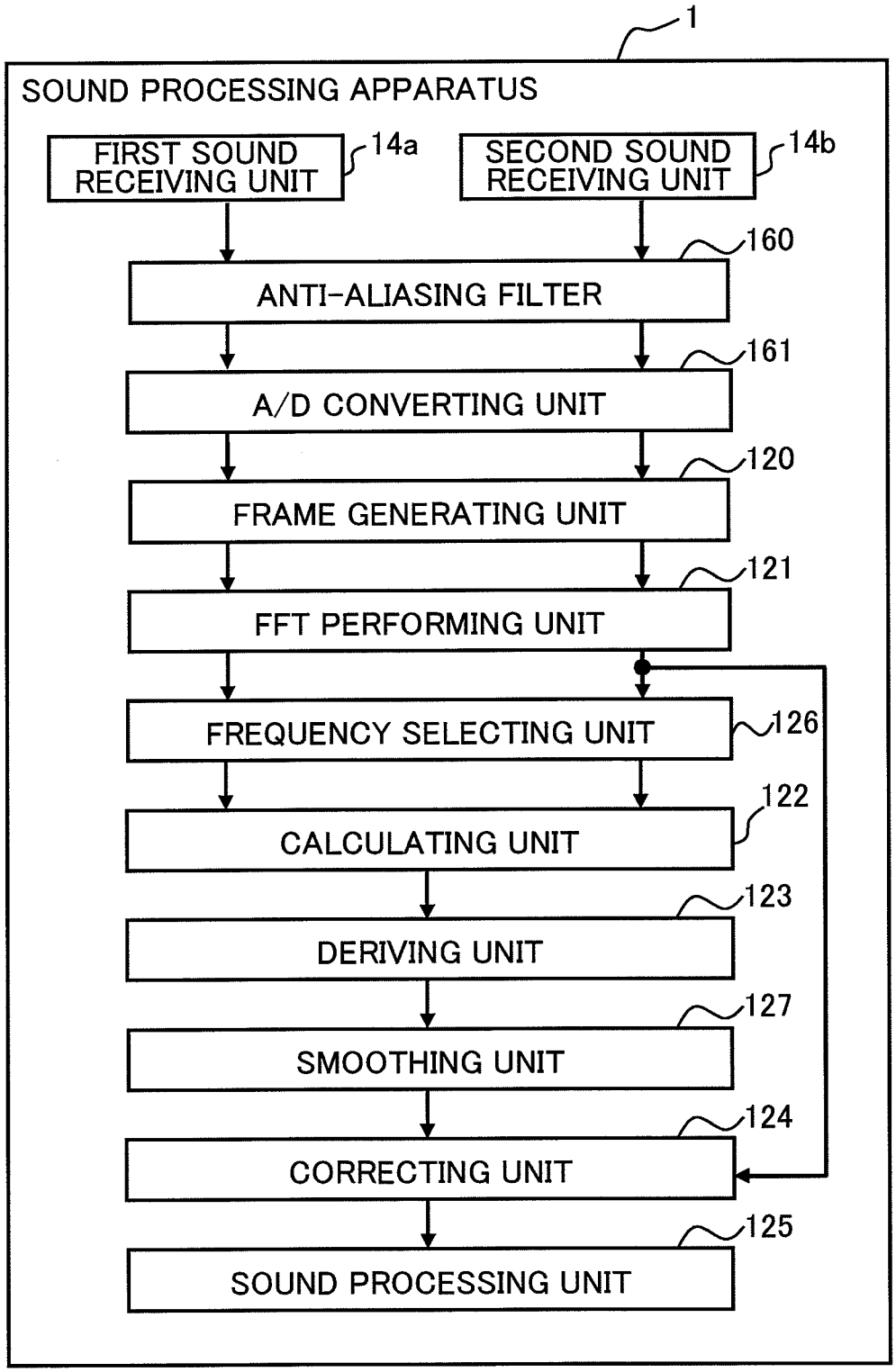
FIG. 9 is a functional block diagram illustrating an exemplary function of a sound processing apparatus according to a second embodiment of the present invention.

FIG. 9 is a functional block diagram illustrating an exemplary function of a sound processing apparatus 1 according to the second embodiment. The sound processing apparatus 1 of the present invention includes a first sound receiving unit 14*a* and a second sound receiving unit 14*b*, an anti-aliasing filter 160, and A/D converter 161 that performs analog-to-digital conversion. The first sound receiving unit 14*a* and the second sound receiving unit 14*b* include amplifies (not shown) that amplifies analog sound signals.

The sound processing apparatus 1 further includes frame generating unit 120, FFT performing unit 121, calculating unit 122 that calculates power spectral ratios, deriving unit 123 that calculates phase correction values, correcting unit 124, and sound processing unit 125. In addition, the sound processing apparatus 1 includes frequency selecting unit 126 that selects frequencies used for calculation of the power spectral ratios performed by the calculating unit 122 and smoothing unit 127 that smoothes time changes of the correction values calculated by the deriving unit 123. The frame generating unit 120, the FFT performing unit 121, the calculating unit 122, the deriving unit 123, the correcting unit 124, the sound processing unit 125, the frequency selecting unit 126, and the smoothing unit 127 are functions as software realized by executing various computer programs in a storage unit 12. However, these functions can be realized by using dedicated hardware such as various processing chips of integrated circuits.

Figure 10:
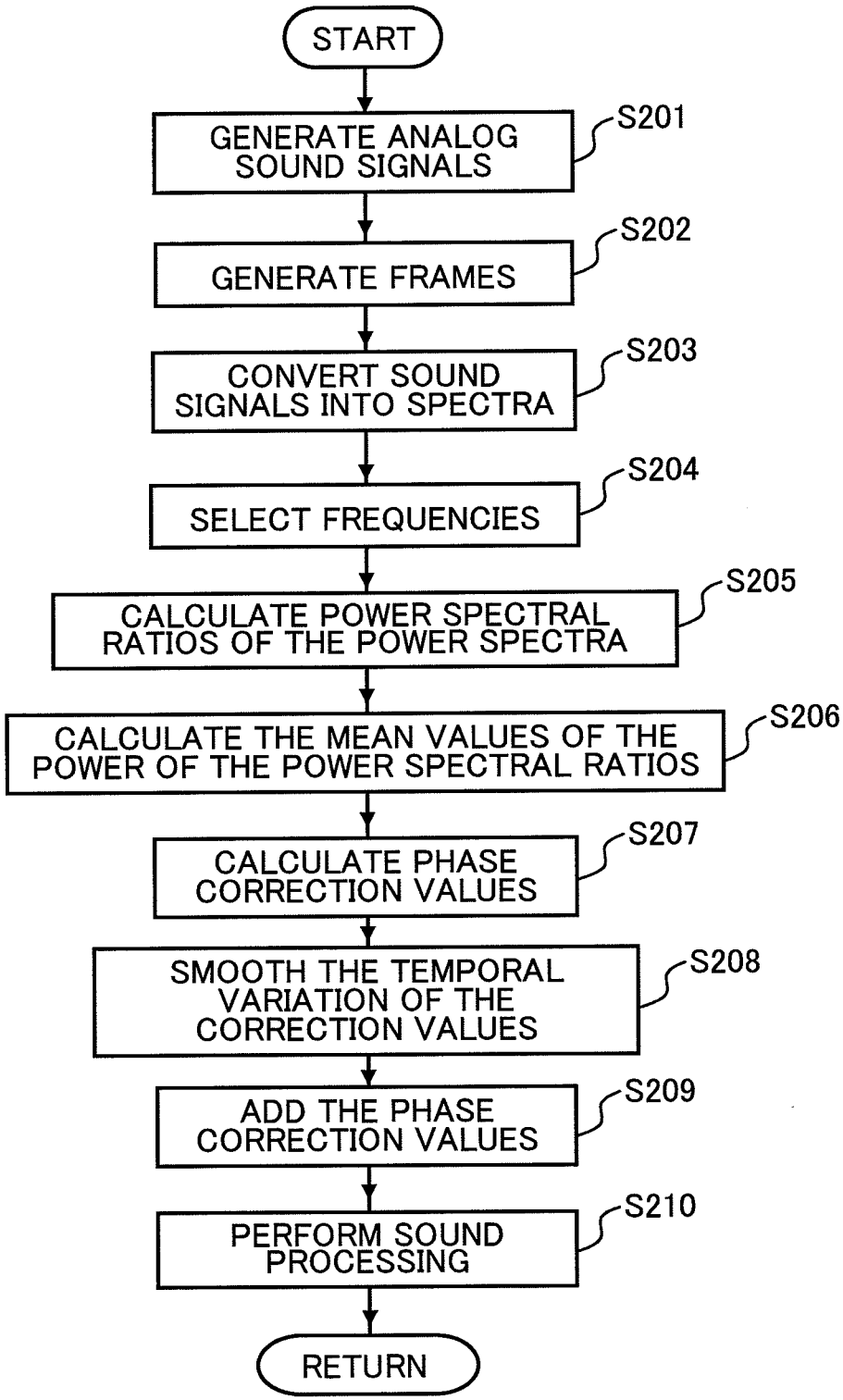
FIG. 10 is an operation chart illustrating exemplary processes performed by the sound processing apparatus according to the second embodiment.
Figure 11:
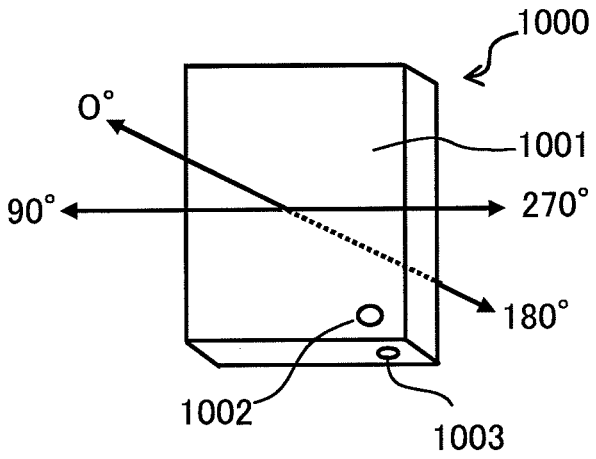
FIG. 11 is a perspective view illustrating an example of an outside shape of a conventional sound processing apparatus.
Figure 12:
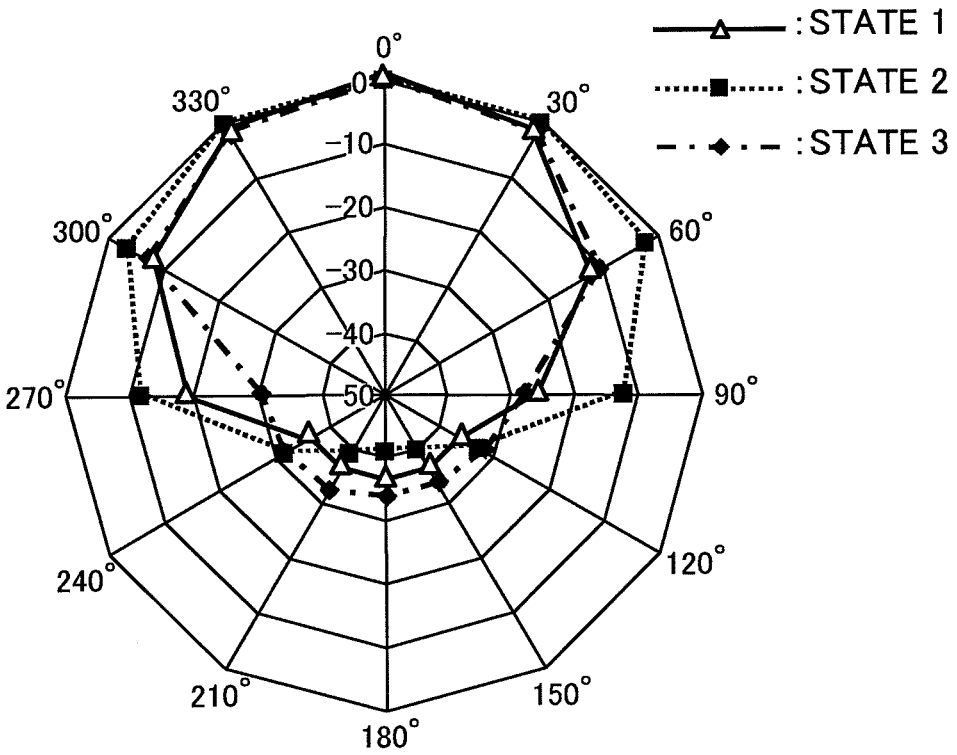
FIG. 12 is a radar chart illustrating measurement results of the directivity of the sound processing apparatus shown in FIG. 11.

Next, processes performed by the sound processing apparatus 1 according to the second embodiment will be described. FIG. 10 is an operation chart illustrating exemplary processes performed by the sound processing apparatus 1 according to the second embodiment. The sound processing apparatus 1 generates analog sound signals on the basis of the sound received by the corresponding sound receiving units 14 by the control of the control unit 11 that executes the computer program 100 (S200), filters the signals using the anti-aliasing filter 160, and converts the signals into digital signals using the A/D converter 161.

The sound processing apparatus 1 divides each of the sound signal into frames having a predetermined time length serving as a processing unit from each of the sound signals converted into the digital signals in the process performed by the frame generating unit 120 on the basis of the control of the control unit 11 (S202), and converts the sound signals in units of frames into spectra serving as frequency-domain signals by FFT processing in the process performed by the FFT performing unit 121 on the basis of the control of the control unit 11 (S203).

The sound processing apparatus 1 selects frequencies at which SNRs (Signal to Noise Ratios) are higher than or equal to a predetermined value in a frequency range from, for example, 1,000 to 3,000 Hz that is unaffected by the anti-aliasing filter 160 in the process performed by the frequency selecting unit 126 on the basis of the control of the control unit 11 (S204).

The sound processing apparatus 1 calculates power spectral ratios for the frequencies selected in operation S204 in the process performed by the calculating unit 122 on the basis of the control of the control unit 11 (S205), calculates the mean values of the power spectral ratios (S206), and calculates phase correction values of the frequency-domain sound signals of the second sound receiving unit 14*b* with respect to the frequency-domain sound signals of the first sound receiving unit 14*a* on the basis of the mean values of the power spectral ratios in the process performed by the deriving unit 123 on the basis of the control of the control unit 11 (S207). The processes in operations S205 to S207 are represented by the following Equation (9) or (10).

$$P_{comp} = \left[\alpha F\left\{\frac{1}{N}\sum_{k=1}^{N}(S_1(\omega_k)/S_2(\omega_k))\right\}\right]\omega + \beta \qquad \text{Equation (9)}$$

where, Pcomp is a phase correction value, α and β are constants, N is number of selected frequencies, F( ) is a function, S1(ω) is a power spectrum based on a sound signal of the first sound receiving unit 14*a*, and S2(ω) is a power spectrum based on a sound signal of the second sound receiving unit 14*b*.

$$P_{comp} = \alpha\frac{1}{N}\sum_{k=1}^{N} F\{S_1(\omega_k)/S_2(\omega_k)\}\omega + \beta \qquad \text{Equation (10)}$$

where, Pcomp is a phase correction value, α and β are constants, N is number of selected frequencies, F( ) is a function, S1(ω) is a power spectrum based on a sound signal of the first sound receiving unit 14*a*, and S2(ω) is a power spectrum based on a sound signal of the second sound receiving unit 14*b*.

The phase correction values represented by Equations (9) and (10) are representative values calculated on the basis of the mean values of the power spectral ratios at the selected frequencies, and do not change depending on the select frequencies. In the second embodiment, the processing load can be reduced since the correction values are calculated on the basis of the spectra at the N selected frequencies. Since the subsequent process is related to time changes of the correction values, the phase correction values Pcomp are treated as correction values Pcomp(t), which is a function of time (frame) t.

The sound processing apparatus 1 smoothes the temporal variation of the correction values in the process performed by the smoothing unit 127 on the basis of the control of the control unit 11 (S208). In operation S208, the smoothing process is performed using the following Equation (11).

$$P_{comp}(t)=\gamma P_{comp}(t-1)+(1-\gamma)P_{comp}(t) \quad \text{Equation (11)}$$

where $\gamma$ is a constant from 0 to 1.

In operation S208, the time changes are smoothed using one previous correction value Pcomp(t−1) as shown in Equation (11). Thus, natural sound can be reproduced while sudden changes of the correction values are prevented. Herein, the constant $\gamma$ can be, for example, 0.9. Moreover, when the number of selected frequencies is less than a predetermined value, for example, 5, the constant $\gamma$ can be temporarily set to 1 so that the update of the correction values is stopped. With this, the reliability can be improved since correction values with less accuracy obtained when SNRs are low are not used. Furthermore, in order to prevent unexpected overcorrection caused by, for example, noise, upper and lower limits are desirably set for the correction values. A sigmoid function can be used instead of using Equation (11) so as to smooth the time changes of the correction values.

The sound processing apparatus 1 adds the phase correction values calculated in operation S208 to the phases of the frequency-domain sound signals of the second sound receiving unit 14*b* so as to correct the sound signal of the second sound receiving unit 14*b* in the process performed by the correcting unit 124 on the basis of the control of the control unit 11 (S209). In operation S209, the sound signal is corrected using specific correction values over the entire frequency range.

The sound processing apparatus 1 performs various sound processing such as suppressing the sound received by the first sound receiving unit 14*a* on the basis of the sound signals of the first sound receiving unit 14*a* and the sound signals, whose phases are corrected, of the second sound receiving unit 14*b* in the process performed by the sound processing unit 125 on the basis of the control of the control unit 11 (S210).

The first and second embodiments are only parts of innumerable embodiments of the present invention. It is to be understood that the configurations of the hardware and the software can be set as appropriate, and that various processes other that the above-described basic processes can be combined.

What is claimed is:

1. A sound processing apparatus for processing received sounds comprising:

a plurality of sound receiving units, each of the sound receiving units outputting a sound signal corresponding to a received sound;

a converting unit for converting the sound signals in a time domain into converted signals in a frequency domain;

a calculating unit for obtaining a power spectral ratio between two converted signals;

a deriving unit for deriving a phase correction value by using the power spectral ratio, the phase correction value being derived on the basis of one of the two converted signals; and a correcting unit for correcting a phase of the other of the two converted signals to a phase of the one of the two converted signals to calibrate sensitivity of at least one of the plurality of sound receiving units.

2. The sound processing apparatus according to claim 1, wherein the calculating unit obtains a ratio of power spectrum between the two converted signals.

3. The sound processing apparatus according to claim 2, wherein the phase correction value is expressed in the form of an equation:

$$P_{comp}(\omega)=\alpha F\{S_2(\omega)/S_1(\omega)\}+\beta$$

in which $\omega$ is an angular frequency, Pcomp($\omega$) is the phase correction value, $S_1(\omega)$ is a power spectrum of the one of the two converted signals, $S_2(\omega)$ is a power spectrum of the other of the two converted signals, $\alpha$ and $\beta$ are constants, and $F\{S_2(\omega)/S_1(\omega)\}$ is a function of $S_2(\omega)/S_1(\omega)$.

4. The sound processing apparatus according to claim 2, wherein the phase correction value is expressed in the form of an equation:

$$P\text{comp}(\omega)=[\alpha F\{S_1(\omega)/S_2(\omega)\}]\omega+\beta$$

in which $\omega$ is an angular frequency, Pcomp($\omega$) is the phase correction value, $S_1(\omega)$ is a power spectrum of the one of the two converted signals, $S_2(\omega)$ is a power spectrum of the other of the two converted signals, $\alpha$ and $\beta$ are constants, and $F\{S_1(\omega)/S_2(\omega)\}$ is a function of $S_1(\omega)/S_2(\omega)$.

5. The sound processing apparatus according to claim 3, wherein the function is a logarithm function and the correcting unit executes an addition of the phase correction value to the phase of the other of the two converted signals.

6. The sound processing apparatus according to claim 4, wherein the function is a logarithm function and the correcting unit executes an addition of the phase correction value to the phase of the other of the two converted signals.

7. The sound processing apparatus according to claim 1, wherein the calculating unit is capable of obtaining a ratio between amplitude spectrum of the two converted signal.

8. The sound processing apparatus according claim 1, further comprising;

a smoothing unit for smoothing a temporal variation of the phase correction value, wherein the correcting unit corrects the phase of the sound signal on the basis of the phase correction value smoothed by the smoothing unit.

9. A method for correcting a phase difference between received sound signals, the method comprising the operations of:

transforming each of sound signals in a time domain into a converted signal in a frequency domain respectively, each of the sound signals being corresponding to respective received sound signals;

executing a calculation for obtaining a power spectral ratio between two of the converted signals;

deriving a phase correction value by using the power spectral ratio, the phase correction value being derived on the basis of one of the two of the converted signals; and correcting a phase of the other of the two of the converted signals to a phase of the one of the two converted signals to calibrate a sensitivity for receiving at least one of the received sound signals.

10. A storage medium storing a computer-readable program for causing a computer to execute a method for correcting a phase difference between received sound signals, the method comprising the operations of:

transforming each of sound signals into a converted signal in a frequency domain respectively, each of the sound signals being corresponding to respective received sound signals;

executing a calculation for obtaining a power spectral ratio between two of the converted signals;

deriving a phase correction value by using the power spectral ratio, the phase correction value being derived on the basis of one of the two of the converted signals; and correcting a phase of the other of the two of the converted signals to a phase of another of the two converted signals to calibrate a sensitivity for receiving at least one of the received sound signals.

* * * * *